US006090223A

United States Patent [19]

Kiuchi et al.

[11] Patent Number: 6,090,223

[45] Date of Patent: Jul. 18, 2000

[54] CHROMIUM NITRIDE FILM AND METHOD FOR FORMING THE SAME

[75] Inventors: Masayuki Kiuchi; Makoto Funai, both of Kawasaki, Japan

[73] Assignee: Showa Denko K.K., Tokyo, Japan

[21] Appl. No.: 09/104,352

[22] Filed: Jun. 25, 1998

[30] Foreign Application Priority Data

Jun. 25, 1997 [JP] Japan ..... 9-168534
Jul. 8, 1997 [JP] Japan ..... 9-182570

[51] Int. Cl.[7] ..... C21D 1/06; C23C 8/24; C23C 8/26

[52] U.S. Cl. ..... 148/220; 148/230; 148/238; 148/217; 148/214; 420/317; 420/318

[58] Field of Search ..... 148/220, 230, 148/238, 217, 214, 317, 318

[56] References Cited

U.S. PATENT DOCUMENTS

| | | | |
|---|---|---|---|
| 5,141,567 | 8/1992 | Tahara et al. . | |
| 5,226,975 | 7/1993 | Denton et al. | 148/220 |
| 5,403,409 | 4/1995 | Tahara et al. . | |

FOREIGN PATENT DOCUMENTS

| | | | |
|---|---|---|---|
| 57-035679 | 2/1982 | Japan | C23C 11/14 |
| 274753 | 11/1988 | Japan | 148/220 |
| 3-044457 | 2/1991 | Japan | C23C 8/26 |
| 5-311396 | 11/1993 | Japan | C23C 14/06 |
| 7-109561 | 4/1995 | Japan | C23C 14/06 |
| 377448 | 4/1973 | Russian Federation | 148/220 |
| 1320902 | 6/1973 | United Kingdom | 148/220 |

*Primary Examiner*—Deborah Yee
*Attorney, Agent, or Firm*—Sughrue, Mion, Zinn, Macpeak & Seas, PLLC

[57] ABSTRACT

By forming a Cr playing layer on the surface of a metal and forming a CrN film by nitriding the surface thereof, it is possible to improve the surface hardness, wear resistance, corrosion resistance, etc., of the metal; wherein the nitriding treatment of the Cr plating layer surface is carried out by a method of heating in a nitrided atmosphere, preferably heated in a nitrided atmosphere which includes an ammonia decomposed gas treated in advance with an ammonia decomposition catalyst as a nitrogen source; in addition it is preferable that before the nitriding treatment, the Cr plating layer surface is purified and activated by heating in a halogen compound or a reacting gas which includes halogen.

25 Claims, No Drawings

CHROMIUM NITRIDE FILM AND METHOD FOR FORMING THE SAME

SUMMARY OF THE INVENTION

1. Field of the Invention

The present invention relates to a method of formation of a CrN film on the surface of metallic materials, improving the surface hardness, wear resistance, and anti-corrosiveness, etc.

This application is based on patent applications No. Hei 9-168534 and Hei 9-182570 filed in Japan, the content of which is incorporated herein by reference.

2. Description of the Related Art

Conventionally, in order to improve the chemical and mechanical properties of the surface hardness, wear resistance, corrosion resistance, and fatigue resistance of metallic materials, the method of Cr plating of the metallic material and the method of forming a nitride layer on the surface of steel are generally practiced.

However, with either of these methods, the surface hardness of the metal is raised to only about 800~1000 Hv.

Recently, there is strong demand to make the surface of metals even more hard and wear resistant, and attention is being given to chromium nitrides (CrN and $Cr_2N$) having a hardness of 1500~2400 Hv.

In this context, the following methods have been proposed for forming a CrN film for improving the surface hardness, wear resistance, etc., of the metal material:

1. ion plating,
2. sputtering, and
3. ion irradiation.

The ion plating method uses a vacuum arc discharge in a vacuum chamber; irradiates the work by vaporizing and ionizing a metal chromium target; ionized chromium is attracted to the work to which a negative bias voltage is applied; and chromium nitride is formed by introducing nitrogen into the vacuum chamber.

The sputtering method produces a glow arc in a vacuum chamber by applying a high voltage between the target, which is the coating, and a substrate; bombards the target surface with ionized Ar made into a plasma by the arc; and the ejected chromium atoms are deposited on the substrate. At the same time, nitrogen is introduced to the chamber to allow formation in solid-solution by supersaturation of a chromium film and the chromium nitride film with the nitrogen.

Finally, the ion irradiation method is a method combining nitrogen ion irradiation with either vacuum deposition or sputtering (Japanese Patent Application, First Publication, No. Hei 5-311396), and makes possible the formation of a CrN film at low temperature.

However, in contrast to conventional processing, vapor phase coating by ion plating, sputtering, or ion irradiation, for example, have the problems of high cost and form and size limitations on the work because a high vacuum environment is a necessary condition. Because of this, in order to widen its industrial use, the cost of the processing apparatus must be lowered, and the handling system must be simplified.

In addition, one disadvantage of a CrN film in general is that because the thermal expansion rate of CrN is ⅙ that of Fe, thermal stress is easily caused and heat history peeling easily produced, and when processed at low temperature, the adhesiveness between CrN film and substrate is weak.

In this situation, in order to improve the adhesiveness of the substrate and the CrN film, a method has been proposed wherein nitrogen ions are applied after formation of the Cr layer by vacuum deposition, and the ratio of the composition of the chromium atoms and the nitrogen atoms in the nitride chromium film is changed stepwise or continuously (Japanese Patent Application, No. Hei 7-109561). However, in this method, the film of the chromium nitride film is thin, and it has practically no effect on preventing thermal history peeling, which is due to the difference in thermal heat expansion.

Additionally, in order to improve the mechanical properties of the wear resistance, corrosion resistance, fatigue resistance, etc., of metal materials, the following methods have been proposed as nitriding methods for forming a nitride film on the surface of steel:

1. Tufftride method,
2. ion nitriding, and
3. gas nitriding.

Among these, because the Tufftride method uses a toxic cyan fused salt, it is not desirable from the point of working environment and waste processing. In addition, ion nitriding restricts the shape and dimensions of the work, and has a high cost. Gas nitriding has problems relating to stability in that, for example, it may produce uneven nitriding. Additionally, to obtain a thick nitride layer by gas nitriding, the processing requires a long time.

In nitriding using an $NH_3$ gas, at the nitriding temperature, a nitride is formed by active nitrogen produced by $NH_3$ gas being absorbed and dissociated on the surface of the metal, and penetrating and spreading within the metal, and then a nitride layer is formed. Therefore, the nitriding speed is limited by these factors.

The major problem with this type of gas nitriding method is that when nitriding is carried out at low temperature, the nitride processing takes a long time. To deal with this problem, several improved methods have been proposed for accelerating nitriding. Proposed methods include a method of impregnating Cr—Al steel, a conventional nitrided steel, with Ti; a method of substituting an oxidized film with fluoride by using a reacting gas which includes fluorine (Japanese Patent Publication, No. Hei 8-9766); a method of two-stage nitriding in which the nitriding temperature is changed stepwise; an method of gradient nitriding in which the nitriding temperature is changed continuously; and a method wherein decomposed $NH_3$ used in nitriding is placed in forced circulation in a fluidized bed furnace, mixed with $NH_3$ gas, and re-used in nitriding (Japanese Patent Publication, No. Sho 58-9154).

However, in these improved methods, the method of compounding the Ti changes the basis metal itself and is not practical. Methods which carry out fluoride pre-processing are a problem because they use toxic fluorine gases. The two-stage method and the gradient method cannot be applied in field s demanding dimensional stability because they raise the nitride temperature in order to accelerate diffusion. In addition, the method of putting $NH_3$ in a forced circulation has the problem of a limited ability to control the rate of decomposition.

Therefore, the object of the present invention is to obtain efficiently a desired surface film which improves the chemical and mechanical properties of the surface hardness, wear resistance, corrosion resistance, fatigue resistance, and so on, of the metallic material.

SUMMARY OF THE INVENTION

The CrN film of the present invention is characterized in that a chromium plating layer is formed on the surface of a metal, and the surface of this chromium plating layer is nitrided.

This CrN film can drastically improve the hardness and wear resistance of the metal surface. In addition, the surface film has a superior adhesion with the basis metal, prevents thermal history peeling, and can even endure thermal shock.

The CrN film of the present invention is formed by a method comprising a Cr plating step wherein Cr plating layer is formed by carrying out Cr plating on the surface of the metal, and a nitriding treatment step wherein a part of this Cr plated surface is nitrided by heating in a nitrided atmosphere after this Cr plating step.

The method for forming the CrN film of the present invention has a low processing cost, places no limitations on the shape or size of the work, therefore this method simplifies manufacturing, and can be widely implemented in industry.

More specifically, after the Cr plating step, a CrN film can be quickly and evenly formed even at low temperature by providing a surface activation step wherein the above-mentioned Cr plating surface is purified and activated by heating in a halogen compound or in a reacting gas which contains halogen.

The nitriding method of the metal of the present invention is characterized by the formation of a nitrided layer by heating the metal in a nitrided atmosphere which includes a decomposed ammonia gas as the nitrogen source, treated in advance by an ammonia decomposition catalyst.

By this method, a nitrided layer can be formed evenly, quickly, and without irregularities, and furthermore, it allows processing at low temperature, and thus can be applied to the manufacturing of precision parts.

DESCRIPTION OF THE PREFERRED EMBODIMENTS

The inventors carried out many thorough studies with the object of developing a method which can form a strong CrN film quickly and evenly on the surface of a metal, is economically superior, and has wide use, and developing a CrN film whose adhesion to the basis metal is superior and has little thermal history peeling. As a result, the present completed invention is an effective method of forming a CrN film using nitride treatment by maintaining the basis metal, which is the work, in a heated nitride atmosphere after carrying out Cr plating on the surface thereof, and by providing a Cr plating of 1~50 $\mu$m between the basis metal and the CrN film by this method, obtaining a CrN film whose adhesion to the basis metal is superior and has little thermal history peeling.

In addition, as a result of the present inventors carrying out many thorough investigations with the aim of developing a method which can quickly and evenly form a nitride layer on the surface of a metal at even low temperature, an effective nitriding treatment method was found. That is, in a gas nitriding method using $NH_3$, it was found that by producing an active nitrogen by bringing $NH_3$ into contact with an ammonia decomposition catalyst and decomposing it at a temperature equal to or less than 500° C., nitrogen atoms were absorbed and diffused more quickly and evenly on the metal surface, and that in this manner it is possible to form a nitride layer quickly and evenly at low temperature.

The CrN formation method of the present invention is economically superior, and has more wide use to conventional technology because it does not require a high vacuum, and has wide use.

In addition, it is thought that one factor in thermal history peeling is thermal stress due to the difference between thermal expansion rates. For example, the thermal expansion rate of Fe is $13.8\times10^{-6}$ (/deg), and other non-ferrous metals besides Cr show values equal to or larger than this. Thus, because the thermal expansion of CrN is a small $2.3\times10^{-6}$ (/deg), conditions are created wherein thermal stress is easily produced. However, the thermal expansion rate of Cr is $8.4\times10^{-}6$ (/deg), showing a value between that of the metal and CrN. Thus, it thought possible to disperse and inhibit thermal stress by forming Cr plating between the basis metal and the CrN film.

Furthermore, in the present invention, before forming the CrN film, pre-treatment with a halogen compound or with a reacting gas which includes halogen is possible. This can be carried out by maintaining the work before CrN film formation in a heated halogen compound or in a heated reacting gas includes halogen. Using this pre-treatment, the surface is cleaned by destructive elimination of inorganic and organic contaminants which are attached to the Cr plating surface. Furthermore, the oxidized film and the $O_2$ absorption layer which exists in the Cr plating layer are eliminated, therefore the Cr plating surface is activated. In the CrN film formation, the Cr plated surface activated in this manner, compared to an untreated Cr plating surface, exhibits easy absorption, penetration, and diffusion of nitrogen atoms, and a CrN film is quickly and evenly formed even at lower temperatures. In this manner, forming a CrN film quickly even at low temperatures is particularly effective when it is preferred that the distortions or deformations are not produced in the work.

In the following, the present invention will be explained in detail. The metals used in this invention are not limited in particular; any metal that can be Cr plated can be used. For example, it can also be applied to steel, iron, and non-ferrous metals. In addition, it is possible to combine the invention with other plating treatments.

As a Cr plating used in the Cr plating step in the present invention, in addition to conventional industrial Cr plating, special Cr plating methods, for example, uncracked high corrosion resistant Cr plating, micro-porous Cr plating, and amorphous Cr plating which includes 2~4% carbon, can be used. The thickness of the Cr plating formed in the Cr plating process is not particularly limited, but is preferably 2~50 $\mu$m. The shape and dimensions of the work are not particularly limited, but in industrial contexts, it is possible to use the invention for semi-conductor sealing metal cavities, rubber form cavities, injection molded parts, cylinders and liners, pistons and piston rods, piston rings, tools, shafts and journals, rolls, and machine parts, for example.

As a halogen compound or a reacting gas including halogen used in the surface activation step in the present invention, it is possible to use, respectively, salt baths such as NaCl, KCl, $CaCl_2$, $CaF_2$, KF, NaF; or chlorine gases such as $Cl_2$, HCl, $CH_3Cl$; and fluorine gases such $F_2$, HF, $ClF_3$, $NF_3$, $BF_3$, $CF_4$, or $SF_6$. In particular, halogen gases diluted with inert gases, for example $N_2$, Ar, etc., are usable, a halogen concentration in the range of 0.1~100% can be used, and generally, a treatment temperature between 20~4000 and treatment time of 10~480 minutes are used.

In more detail, among the above-described compounds, $ClF_3$ is preferable because its reactivity is high even at low temperatures, and treatment at a lower concentration is possible.

Next, the nitriding method used in the present invention is explained. As an ammonia decomposition catalyst, a catalyst which has an ammonia decomposition capacity under 500° C. can be used. It is possible, for example to use nickel, iron, or ruthenium catalysts.

In more detail, from the point of view of low temperature activation, it is preferable to use an ammonia decomposition catalyst in which ruthenium and alkaline metals are borne by carriers, and whose halogen content is equal to or under 100 ppm by weight of the catalyst. This alkaline metal should include at least one type chosen from Na, K, Rb, or Cs. In this ammonia decomposition catalyst, the ruthenium content should be in the range 0.1%~5% by weight of the catalyst, and the content of the alkaline metal should be in the range of 1%~30% by weight of the catalyst.

Moreover, the nitriding treatment using this ammonia decomposition catalyst is not limited to a Cr plating. It can also be applied to metals such as steel, aluminum, nickel, titanium, tungsten, tantalum, and molybdenum. The steels include different types of steels such as carbon steel, stainless steel, etc. In addition, metals are not limited to the simple substances such as those described above, but can include alloys combining the above-mentioned materials, and include, for example, cladding materials and the plating treatment materials. The shape of these metals is not limited in particular, so plates, rods, and coils, processed forms, and powders can be used without problem.

Here, the ammonia decomposition method using this ammonia decomposition catalyst will be explained. Basically, in the equation shown below, this ammonia decomposition method produces 3 moles of hydrogen and 1 mole of nitrogen from 2 moles of ammonia, basically by bringing a gas including ammonia into contact with the catalyst at a raised temperature:

$$2NH_3 \rightarrow 3H_2 + N_2.$$

This ammonia decomposition reaction is an equilibrium and endothermic reaction, and is a reaction in which the volume increases. Therefore, by applying conditions of low pressure and high temperature to the reaction, it is possible to accelerate the reaction in the decomposition direction.

When using this catalyst, it is possible to efficiently decompose the ammonia with a pressure in the range of 0.1 Mpa~1.0 MPa, and a temperature within the range of 500° C.~700° C. Even if the pressure is less than 0.1 MPa, the reaction will progress, but because decompression apparatus is necessary, it is not advantageous. When the pressure exceeds 1.0 MPa, the reaction equilibrium favors the formation of ammonia and is not desirable. When the temperature is less than 500° C., the decomposition rate is insufficient, and when it exceeds 700° C., an expensive thermal resistant apparatus is necessary, and there is also a deleterious influence on the catalyst lifetime, and is not advantageous.

The decomposed gas obtained from this kind of ammonia decomposition method includes hydrogen and nitrogen in a molar ratio of 3:1. Therefore, it is also possible to use this gas for bright annealing of stainless steel, nickel, nickel-copper alloys, or nickel-chromium alloys. In this decomposed gas, it is possible that trace amounts of $NH_3$, $H_2O$, $NO_x$, and $CO_2$ are included as impurities. If these impurities become detrimental, in the recovery step which follows the contact decomposition step, it is possible to eliminate them easily by absorption in, for example, zeolite or activated carbon.

The method for carrying out nitride treatment using the present catalyst is not particularly limited, the methods wherein a supplied $NH_3$ is in contact with ammonia decomposition catalyst are usable. For example, it is possible to use such methods as introducing $NH_3$ gas which includes activated nitrogen into a nitriding furnace via an ammonia decomposition furnace filled with ammonia decomposition catalyst, producing activated nitrogen by inserting an ammonia decomposition catalyst in a nitriding furnace to make an ammonia decomposition zone, or filling a nitriding furnace with ammonia decomposition catalyst and laying the work in the catalyst.

The gas incorporating ammonia used to form the nitride atmosphere is not particularly limited, and reaction gases which include $NH_3$ with decomposing properties are usable. For example, it is possible to use $NH_3$ appropriately diluted with inert gases such as $N_2$, helium, or argon, or further mixed with $H_2$, $CO_2$, and $CH_3$.

Nitriding using the present decomposed gas is generally carried out between 300° C.~700° C., which is the nitriding treatment temperature for steel, and preferably at a temperature between 400° C.~500° C., for several hours or several tens hours. However, even at a temperature equal to or less than 500°, it is sufficient that the temperature produce the decomposition reaction of the decomposition catalyst. When it is desirable that the temperature be equal to or less than 500° C. because of the problems related to the heat resistance of the work, it is sufficient to maintain as low a temperature as possible above the temperature which the decomposition catalyst shows a capacity for decomposition, and extend the treatment time. This is because the nitriding rate is controlled by the absorption of the active nitrogen into the metal and the diffusion of the nitrogen within the metal, and lowering the nitriding temperature slows the diffusion. Thus, in order to obtain the necessary nitride layer a long treatment time is necessary. In addition, generally in the case of high fusion point metals such as titanium, chromium, tungsten, and tantalum, the diffusion coefficient of nitrogen is low compared to steel, and additionally, because chromium and tantalum have a high affinity with oxygen, they are easily influenced by an oxidized film on the surface, so the nitriding rate is extremely low.

Therefore, when nitriding treatment is conducted on the Cr plating with the present invention, cleaning the Cr plating surface by pre-treatment and eliminating the oxidized film and $O_2$ absorption film to activate the Cr plating surface is effective in increasing the nitriding rate.

In addition, in the case, for example, of the nitriding of steel, the $NH_3$ decomposition rate is experimentally found to be optimal at 15%~30%, but this is a value obtained experimentally from results of measurement of surface hardness in nitrided steel, and an optimal value exists for each of the metals which are the object of treatment. In connection with the $NH_3$ decomposition rate, generally the higher the decomposition rate is, the more the development of surface brittleness can be suppressed. If however, the decomposition rate is too high, the diffusion rate of the nitrogen into the interior tends to become slow, and the nitrided layer to become thin, while at a decomposition rate equal to or greater than 90%, severe denitration occurs, and the nitriding rate becomes even lower. Because the decomposition of $NH_3$ is a contact decomposition, decomposition is produced by contact with the surface of the work or the inner surface of the nitriding furnace. Therefore, in order to increase the NH3 decomposition rate when nitriding at a temperature equal to or lower than 500° C., it is necessary to decrease the amount of gas supplied, but if the amount of gas supplied is decreased, the problems arise that the nitriding is inconsistent and surface irregularities are produced. In order to solve these problems, in the present invention it is possible to control the $NH_3$ decomposition rate even when the amount of gas supply is high without producing nitriding irregularities by using an ammonia decomposition catalyst, and additionally, by accelerating the production of active nitrogen, a nitrided layer having no irregularities can be formed quickly and evenly at low temperature.

Below, the method for forming the CrN film of the present invention is explained concretely.

First, after the work which has been Cr plated is degreased by washing, it is inserted into a heated furnace. It is preferable that after Cr plating, the work is continuously degreased by washing and inserted into a heated furnace, but even if the product is used after the passage of time, the method of the present invention is not affected. Next, the heating furnace is filled with inert gases such as $N_2$ or Ar, and so on. Further, if necessary, the temperature is raised to or below 400° C. In this case, the flow of the inert gas may be continuous, or it is possible to stop the flow of the inert gas and make the heating furnace a vacuum using a vacuum pump. This operation has the object of the sufficient elimination and desorption of water and oxygen which harm the later halogen pre-treatment and the CrN film formation treatment (nitriding treatment).

Then as necessary, after adjusting the heating furnace to the pre-treatment temperature (20° C.~40$^{0}$° C.), a halogen compound or a reacting gas including halogen, for example, a gas mixture of $Cl_2$ and $N_2$ or a gas mixture of $ClF_3$ and $N_2$, is introduced. $Cl_2$ and $ClF_3$ produce the active radicals Cl and F which eliminate the contaminants remaining on the surface and activate the surface by quickly reacting with the oxidized film and absorbed $O_2$ existing on the Cr plating surface.

To the pre-treated work obtained in this manner, the CrN film formation treatment (nitriding treatment) is applied after the remaining halogen compound or reacting gas contains halogen is replaced with the non-oxidizing atmosphere of an inert gas atmosphere such as $N_2$ or Ar.

The CrN film formation treatment (nitriding treatment) is conducted by maintaining a temperature between 300° C.~700° C., preferably between 400° C.~500° C., and introducing a nitride atmosphere gas which includes $NH_3$, for example, a gas mixture of $NH_3$ and $N_2$.

At this time, a nitriding atmosphere gas including $NH_3$ is obtained in an ammonia decomposition reaction furnace by bringing the reacting gas which includes $NH_3$ into contact with an ammonium decomposition catalyst at a temperature equal to or below than 500° C., and producing an ammonia decomposed gas which includes active nitrogen. The optimal value of the decomposition rate of the $NH_3$ in the nitriding treatment using the ammonia decomposition catalyst changes depending on the type of metal and the nitriding temperature, but generally, 20%~80% is preferable. The decomposition rate of $NH_3$ can be arbitrarily controlled by changing the contact temperature and rate of contact with the ammonia decomposition catalyst. The nitriding treatment time is determined by the type of metal, the nitriding temperature, and the thickness of the necessary nitriding layer or hardened layer (the CrN film of the present invention), but generally, several hours or several tens of hours are necessary. After completion of the nitriding, the heating furnace is cooled, and after being cooled to a temperature equal to or less than 50° C., the ammonia decomposition gas supply is stopped, and after replacement with an inert gas such as $N_2$, helium, or argon, etc., the work is removed. In conventional nitriding methods, such inconveniences arise as the degree of absorption of active nitrogen being low and uneven, and producing nitriding irregularities and insufficiency in the nitriding depth on the surface of the work. In the nitriding treatment using the present catalyst, an even nitriding layer is quickly formed on the work by active nitrogen produced by the decomposition of the $NH_3$, the above problems do not arise.

In addition, in the CrN film formation treatment (nitriding treatment), in order to form an active Cr layer efficiently, treatment using a reducing environment gas which includes $H_2$ can be applied before the CrN formation treatment. In this manner, because an active Cr layer is formed, active nitrogen (N) produced by $NH_3$ decomposition is absorbed, and easily penetrates and diffuses into the metal. A nitrided chromium layer, for example, CrN or $Cr_2N$, etc. forms on the surface of the work according to the following reaction formula:

$$2Cr+N \rightarrow Cr_2N \quad (1)$$

$$Cr+N \rightarrow CrN \quad (2)$$

There is the problem that if the CrN film formation is conducted directly after Cr plating, without halogenation treatment, the processing time increases because the activity of the Cr plating surface is lowered by the oxide film or absorbed contaminants which exist on the surface of the Cr plating, but under these conditions the CrN film of the present invention can be formed. The process of CrN film formation first forms the $Cr_2N$, the N is absorbed and diffused, and then the CrN is formed. Therefore, the proportion of $Cr_2N$ in the deepest part is high and the proportion of CrN in surface of the work is high. The CrN film of the present invention is not limited to just CrN, but is a film having a concentration gradient for CrN and $Cr_2N$. The thickness of the CrN film and the $Cr_2N$ film is not limited in particular, but usually 1~20 $\mu$m is suitable.

In this manner, the obtained CrN film of the present invention is a multi-layer structure having a Cr plating layer of 1~50 $\mu$m between the basis metal and the CrN film. This structure has the effect of dispersing and suppressing thermal stress produced by the large difference between the thermal expansion rate of the meal and the thermal expansion rate of CrN. However, when the thickness of the Cr plating layer is equal to or less than 1 $\mu$m, this effect is almost nonexistent, and if the thickness is equal to or greater than 50 $\mu$m, there is practically no effect because it becomes fragile. In addition, the structure in which a CrN film is built up on a Cr plating surface in this manner not only increases the surface hardness and the wear resistance, but it is also possible to increase the Cr platting corrosion resistance.

PREFERRED EMBODIMENTS

EXAMPLE 1

A sample, a test piece (15 mm×30 mm×2 mm) of JIS-SKD 61 (C: 0.32~0.42%, Cr: 4.5~5.50%, Mo: 1.00~1.50%, V: 0.80~1.20%, Si: 0.80~1.20%, Mn: 0.50% or less, P: 0.030% or less, S: 0.030% or less) as stipulated by the Japan Industrial Standards as a hot working alloy machine tool steel which is applied with an industrial chromium plating of 10 $\mu$m, was degreased by ultrasonic treatment in acetone for 60 seconds.

The degreased sample was inserted into a reacting furnace (30 mmϕ×400 mm), and after exchanging $N_2$ gas two times, it was heated to 50° C. Then 1% $ClF_3$ diluted with $N_2$ was introduced and this condition maintained for 1 hour.

At the same time, ruthenium at 1% by weight of the catalyst and cesium at 10% by weight of the catalyst were carried by alumina, and halogen elimination from the carrier was conducted so that the amount of halogen was equal to or less then 100 ppm of the catalyst weight, obtaining the ammonia decomposition catalyst. An ammonium decomposition reaction furnace (16 mmϕ×100 mm) was filled with 3.7 g of the prepared ammonium decomposition catalyst, and after applying a reducing treatment by circulating $H_2$ at 500° for 5 hours, $H_2$ was replaced with $N_2$, the temperature was then lowered to 350°, and a 40% $NH_3$ gas diluted with $N_2$ was obtained.

In addition, in the above-mentioned reaction furnace, after exchanging the residual gas including $ClF_3$ by circulating $N_2$, the 40% $NH_3$ gas diluted with $N_2$ was introduced, the temperature was raised to 500° C., and CrN film formation treatment was carried out for 24 hours at 500° C. At this time, $NH_3$ is circulated so that the decomposition rate of the $NH_3$ gas in the reaction furnace is 50%.

After treatment is complete, the furnace is cooled by standing in air and the sample removed. The CrN and $Cr_2N$ film of the obtained sample was uniform and had a thickness of 2 μm, and a Cr plating layer of 8 μm was formed between the JIS-SKD 61 basis metal and the CrN film. The hardness of the JIS-SKD 61 base material was 500~600 Hv, and with only the Cr plating treatment is 900~1000 Hv, while the hardness of the obtained sample was 1800~2000 Hv. The result of a reciprocating wear test is 360 ds/μm with only the Cr plating treatment, while it was 820 ds/μm for the obtained sample. The result of the liquid heating-cooling shock test (100 cycles) showed no particular abnormalities in the appearance, etc.

EXAMPLE 2

A CrN film was formed by changing the surface activation processing conditions using a halogen in the above-described Example 1.

That is, like the Example 1, a sample which was a JIS-SKD 61 test piece (15 mm×30 mm×2 mm) applied with an industrial chromium plating of 10 μm was degreased by ultrasonic treatment in acetone for 60 seconds.

The degreased sample was inserted into a reacting furnace (30 mmϕ×400 mm), and after exchanging $N_2$ gas two times, it was heated to 50° C. Then 10% $Cl_2$ diluted with $N_2$ was introduced and this condition maintained for 1 hour.

At the same time, ruthenium at 1% by weight of the catalyst and cesium at 10% by weight of the catalyst were carried by alumina, and halogen elimination from the carrier was conducted so that the content of halogen was equal to or less then 100 ppm of the catalyst weight, obtaining an ammonium decomposition catalyst. An ammonium decomposition reaction furnace (16 mmϕ×100 mm) was filled with 3.7 g of the prepared ammonium decomposition catalyst, and after implementing a reducing treatment by circulating $H_2$ at 500 for 5 hours, $H_2$ was replaced with $N_2$, the temperature was then lowered to 350°, and a 40% $NH_3$ gas diluted with $N_2$ was obtained.

In addition, in the above-mentioned reaction furnace, after exchanging the residual gas including $Cl_2$ by circulating $N_2$, the 40% $NH_3$ gas diluted with $N_2$ obtained above was introduced, the temperature was raised to 500° C., and CrN film formation treatment was carried out for 24 hours at 500° C. At this time, $NH_3$ was circulated so that the decomposition rate of the $NH_3$ gas in the reaction furnace was 50%.

After treatment was complete, the furnace was cooled by standing in air and the sample removed. The CrN and $Cr_2N$ film of the obtained sample was uniform and had a thickness of 1.8 μm, and a Cr plating layer of 8.2 μm was formed between the JIS-SKD 61 basis metal and the CrN film. The hardness of the JIS-SKD 61 base material is 500~600 Hv, and with only the Cr plating treatment is 900~1000 Hv, while the hardness of the obtained sample was 1700~1900 Hv. The result of a reciprocating wear test is 360 ds /μm with only the Cr plating treatment, but 800 ds/μm for the obtained sample. The result of the liquid heating-cooling shock test (100 cycles) showed no particular abnormalities in the appearance, etc.

EXAMPLE 3

The CrN film was formed without carrying out the surface activation processing using a halogen in the above-described Example 1.

Like the Example 1, a sample which was a JIS-SKD 61 test piece (15 mm×30 mm×2 mm) applied with an industrial chromium plating of 10 μm was degreased by ultrasonic treatment in acetone for 60 seconds.

At the same time, ruthenium at 1% by weight of the catalyst and cesium at 10% by weight of the catalyst carried by alumina, and halogen elimination from the carrier was conducted so that the content of halogen was equal to or less then 100 ppm of the catalyst weight, obtaining an ammonium decomposition catalyst. An ammonium decomposition reaction furnace (16 mmϕ×100 mm) was filled with 3.7 g of the prepared ammonium decomposition catalyst, and after implementing a reducing treatment by circulating $H_2$ at 500° for 5 hours, $H_2$ was replaced with $N_2$, the temperature was then lowered to 350°, and a 40% $NH_3$ gas diluted with $N_2$ was obtained.

In addition, the degreased sample was inserted unto the above-mentioned reaction furnace (30 mmϕ×400 mm), after exchanging $N_2$ gas two times, the 40% $NH_3$ gas diluted with $N_2$ was introduced, the temperature was raised to 500° C., and CrN film formation treatment was carried out for 24 hours at 500° C. At this time, $NH_3$ was circulated so that the decomposition rate of the $NH_3$ gas in the reaction furnace was 50%.

After treatment was complete, the furnace was cooled by standing in air and the sample removed. The CrN and $Cr_2N$ film of the obtained sample was uniform and had a thickness of 1.5 μm, and a Cr plating layer of 8.5 μm was formed between the JIS-SKD 61 basis metal and the CrN film. The hardness of the JIS-SKD 61 base material is 500~600 Hv, and with only the Cr plating treatment is 900~1000 Hv, while the hardness of the obtained sample was 1600~1800 Hv. The result of a reciprocating wear test is 360 ds/μm with only the Cr plating treatment, but 780 ds/μm for the obtained sample. The result of the liquid heating-cooling shock test (100 cycles) showed no particular abnormalities in the appearance, etc.

EXAMPLE 4

A JIS-SKD 61 test piece (15 mm×30 mm×3 mm, without Cr plating) was degreased in acetone with ultrasonic processing for 60 seconds.

The degreased piece was inserted into a reaction furnace (30 mmϕ×400 mm), and after exchanging $N_2$ gas twice, the water and oxygen in the reaction furnace were eliminated. Next, ruthenium at 1% by weight of the catalyst and cesium at 10% by weight of the catalyst were carried by alumina, and halogen elimination from the carrier was conducted so that the content of halogen was equal to or less then 100 ppm of the catalyst weight, obtaining an aluminum decomposition catalyst. An ammonium decomposition reaction furnace (16 mm ϕ×100 mm) was filled with 3.7 g of a prepared ammonium decomposition catalyst, and after implementing a reducing treatment by circulating $H_2$ at 500° C. for 5 hours, $H_2$ was replaced with $N_2$, the temperature was then lowered to 350° C., and a 40% $NH_3$ gas diluted with $N_2$ was circulated at a velocity of 80 ml/min. At this time, the decomposition rate of $NH_3$ was 40%. This decomposed $NH_3$ gas was introduced into the reaction furnace into which the test piece had been introduced, the temperature raised to 500° C., and nitriding treatment was carried out for 6 hours at 500° C. The decomposition rate of the $NH_3$ gas at the exit of the reaction furnace at this time is 45%. After treatment was complete, the furnace was cooled by standing in air and the test piece was removed. The nitrided layer of the obtained test piece was uniform and had a thickness of 20 μm. The hardness of the JIS-SKD 61 base material is 600 Hv, whereas the obtained test piece was 1000 Hv.

EXAMPLE 5

A test piece (15 mm×30 mm×2 mm) of JIS-SKD 61 applied with an industrial chromium plating of 10 μm was degreased by ultrasonic treatment in acetone for 60 seconds. The degreased test piece was inserted into a reactant furnace (30 mmϕ×400 mm), and the water and oxygen in the reactant furnace was removed by exchanging $N_2$ gas twice. Next, an ammonium decomposition reaction furnace (16 mmϕ×100 mm) was filled with 3.7 g of an ammonium decomposition catalyst prepared as in the Example 4, and after implementing a reducing treatment by circulating $H_2$ at 500° C. for 5 hours. After replacing $H_2$ with $N_2$, the temperature was lowered to 380° C., and a 40% $NH_3$ gas diluted with $N_2$ was circulated at a velocity of 80 ml/min. At this time, the decomposition rate of $NH_3$ was 80%. This decomposed $NH_3$ gas was introduced into the reaction furnace into which the test piece had been placed, and nitriding treatment was carried out for 16 hours at 500° C. The decomposition rate of the $NH_3$ gas at the exit of the reaction furnace at this time was 85%.

After treatment was complete, the furnace was cooled by standing in air and the test piece was removed. The nitrided layer of the obtained test piece was uniform and had a thickness of 3 μm. The hardness of the base material with Cr plating is 900~1000 Hv, while the obtained test piece was 1800~2000 Hv.

COMPARATIVE EXAMPLE 1

Like the Example 1, a sample which was a JIS-SKD 61 test piece (15 mm×30 mm×2 mm) applied with an industrial chromium plating of 2 μm was degreased by ultrasonic treatment in acetone for 60 seconds. The degreased test piece was inserted into a reactant furnace (30 mmϕ×400 mm), and after exchanging $N_2$ gas twice, the temperature was raised to 50° C. Then a 1% $ClF_3$ diluted with $N_2$ was introduced, and this condition was maintained for one hour.

Next, after the residual gas containing $ClF_3$ was exchanged by circulation of $N_2$, a 40%$NH_3$ gas diluted with $N_2$, obtained as in the Example 1, was introduced, the temperature was raised to 500° C., and CrN film formation treatment is conducted for 24 hours at 500° C. At this time, $NH_3$ gas was circulated so that the decomposition rate of the $NH_3$ gas in the reaction furnace was 50%.

After the treatment was complete, the furnace was cooled by standing in air and the sample removed. The CrN and $Cr_2N$ film of the obtained sample was uniform and had a thickness of 2 μm, and the Cr plating layer between the JIS-SKD 61 basis metal and the CrN film completely disappeared. The hardness of CrN and $Cr_2N$ film were 0~600 Hv and 1600~1800 Hv respectively. The result of a reciprocating wear test was 780 ds/μm. The result of the liquid heating-cooling shock test (100 cycles) was that the appearance displayed peeling, cracks, and blister.

COMPARATIVE EXAMPLE 2

On the surface of a JIS-SKD 61 test piece (15 mm×30 mm×2 mm) a 2 μm CrN film was applied by ion plating. The hardness was 1600~1800 Hv. The result of a reciprocating wear test was 360 ds/μm with only Cr plating treatment, while the obtain test piece was 780 ds/μm. The result of the liquid heating-cooling shock test (100 cycles) was that the appearance displayed peeling, cracks, and blister.

COMPARATIVE EXAMPLE 3

After degreasing treatment of a test piece as in the Example 4, it was placed in a reaction furnace, and after exchanging $N_2$ gas twice, a 40% $NH_3$ gas diluted with $N_2$ was introduced as in the Example 4 at 80 ml/min, the temperature raised to 500° C., and nitriding processed for 6 hours at 500° C. At this time, the decomposition rate of the $NH_3$ gas in the furnace was 5%.

After the treatment was completed, the furnace was cooled by standing in air and the test piece removed. The nitriding layer of the obtained test piece was uniform and had a thickness of 1~4 μm. The hardness of the JIS-SKD 61 base material is 600 Hv, while the obtained test piece was 600~800 Hv.

COMPARATIVE EXAMPLE 4

After degreasing treatment of a test piece as in the Example 4, it was placed in a reaction furnace, and exchanging $N_2$ gas twice. Then a 40% $NH_3$ gas diluted with $N_2$ was introduced at 4 ml/min, and nitriding processed for 6 hours at 500° C. At this time, the decomposition rate of the $NH_3$ gas in the reaction furnace was 45%.

After the treatment was completed, the furnace was cooled by standing in air and the test piece removed. The nitriding layer of the obtained test piece was irregular, strikingly uneven, and had a thickness of 2~8 μm. The hardness of the JIS-SKD 61 base material is 600 Hv, while the obtained test piece was 600~900 Hv.

COMPARATIVE EXAMPLE 5

After degreasing treatment of a test piece as in the Example 5, it was placed in a reaction furnace, and after exchanging $N_2$ gas twice, a 40% $NH_3$ gas diluted with $N_2$ was introduced at 80 ml/min as in the Example 4, the temperature raised to 500° C., and nitriding processed for 16 hours at 500° C. At this time, the decomposition rate of the $NH_3$ gas in the reaction furnace was 5%.

After the treatment was completed, the furnace was cooled by standing in air and the test piece removed. The nitriding layer of the obtained test piece was irregular, and the thickness was 0~0.2 μm. The hardness of the JIS-SKD 61 base materials with only the Cr plating is 900~1000 Hv, while the test piece was 900~1200 Hv.

COMPARATIVE EXAMPLE 6

After degreasing treatment of a test piece with Cr plating applied as in the Example 5, it was placed in a reaction furnace, and after exchanging $N_2$ gas twice, a 40% $NH_3$ gas diluted with $N_2$ was introduced at 4 ml/min, the temperature raised to 500° C., and nitriding processed for 16 hours at 500° C. At this time, the decomposition rate of the $NH_3$ gas in the reaction furnace was 85%.

After the treatment was completed, the furnace was cooled by standing in air and the test piece removed. The nitriding layer of the obtained test piece was irregular, strikingly uneven, and had a thickness of 1.0~2.0 μm. The hardness of the JIS-SKD 61 base materials with only the Cr plating is 900~1000 Hv, while the obtained test piece was 1400~1600 Hv.

What is claimed is:

1. A CrN film characterized in that a Cr plated layer is formed on a surface of a metal, and the surface thereof is nitrided to form a CrN film, wherein a thickness of said CrN film on said Cr plated layer is 1~20 μm, and a thickness of said Cr plated layer between said metal and said CrN film is 1~50 μm.

2. A method for forming a CrN film comprising: plating Cr on a surface of a metal to form a Cr plated layer; and nitriding a part of said Cr plated layer by heating in a nitriding atmosphere, wherein said nitriding atmosphere includes, as a nitrogen source, an ammonia decomposed gas, which has been previously treated with an ammonia decomposition catalyst.

3. A method for forming a CrN film comprising: plating Cr on a surface of a metal to form a Cr plated layer;

purifying and activating said Cr plated layer by heating in an atmosphere comprising a halogen compound or a reactive gas which includes a halogen; and nitriding a part of said Cr plated layer by heating in a nitriding atmosphere.

4. A method for forming a CrN film according to claim 3, wherein said nitriding atmosphere includes, as a nitrogen source, an ammonia decomposed gas, which has been previously treated with an ammonia decomposition catalyst.

5. A method for forming a CrN film according to claim 3 wherein said halogen compounds or reactive gas which includes a halogen is a fluorine compound or a gas including fluoride.

6. A method for forming a CrN film according to claim 5 wherein said reactive gas which includes a halogen is a reactive gas which includes $ClF_3$.

7. A nitriding method for a metal comprising forming a nitrided layer by heating the metal in a nitriding atmosphere, which includes, as a nitrogen source, an ammonia decomposed gas, which has been previously treated with an ammonia decomposition catalyst.

8. A nitriding method for a metal according to claim 7 wherein said metal is a Cr plated layer.

9. A method for forming a CrN film according to claim 2, wherein said ammonia decomposition catalyst is a catalyst having an ammonia decomposition capactity at a temperature under 500° C.

10. A method for forming a CrN film according to claim 2, wherein said ammonia decomposition catalyst is selected from a group comprising nickel catalyst, iron catalyst, and ruthenium catalyst.

11. A method for forming a CrN film according to claim 2, wherein said ammonia decomposition catalyst is a catalyst in which ruthenium and alkali metals are borne by carriers whose halogen content is equal to or under 100 ppm by weight of the catalyst, the content of said ruthenium therein is in the range of 0.1%~5% by weight of the catalyst, and the content of said alkali metal therein is in the range of 1%~30% by weight of the catalyst.

12. A method for forming a CrN film according to claim 4, wherein said ammonia decomposition catalyst is a catalyst having an ammonia decomposition capability at a temperature under 500° C.

13. A method for forming a CrN film according to claim 4, wherein said ammonia decomposition catalyst is selected from a group comprising nickel catalyst, iron catalyst, and ruthenium catalyst.

14. A method for forming a CrN film according to claim 4, wherein said ammonia decomposition catalyst is a catalyst in which ruthenium and alkali metals are borne by carriers, whose halogen content is equal to or under 100 ppm by weight of the catalyst, the content of said ruthenium therein is in the range of 0.1%~5% by weight of the catalyst, and the content of said alkali metal therein is in the range of 1%~30% by weight of the catalyst.

15. A nitriding method for a metal according to claim 7, wherein said ammonia decomposition catalyst is a catalyst having an ammonia decomposition capability at a temperature of under 500° C.

16. A nitriding method for a metal according to claim 7, wherein said ammonia decomposition catalyst is selected from a group comprising nickel catalyst, iron catalyst, and ruthenium catalyst.

17. A nitriding method for a metal according to claim 7, wherein said ammonia decomposition catalyst is a catalyst in which ruthenium and alkali metals are borne by carriers, whose halogen content is equal to or under 100 ppm by weight of the catalyst, the content of said ruthenium therein is in the range of 0.1%~5% by weight of the catalyst, and the content of said alkali metal therein is in the range of 1%~30% by weight of the catalyst.

18. A CrN film formed by the steps comprising:

plating Cr on a surface of a metal to form a Cr plated layer; and nitriding a part of said Cr plated layer to form a CrN film by heating in a nitriding atmosphere, including, as a nitrogen source, an ammonia decomposed gas which has been previously treated with an ammonia decomposition catalyst.

19. A CrN film according to claim 18, wherein a thickness of said CrN film on said Cr plated layer is 1~20 μm, and a thickness of said Cr plated layer between said metal and said CrN film is 1~5 μm.

20. A CrN film according to claim 18, wherein said ammonia decomposition catalyst is a catalyst active as an ammonia decomposition capacity at a temperature of under 500° C.

21. A CrN film according to claim 18, wherein said ammonia decomposition catalyst is selected from a group comprising nickel catalyst, iron catalyst, and ruthenium catalyst.

22. A CrN film according to claim 18, wherein said ammonia decomposition catalyst is a catalyst in which ruthenium and alkali metals are borne by carriers, whose halogen content is equal to or under 100 ppm by weight of the catalyst, the content of said ruthenium therein is in the range of 0.1%~5% by weight of the catalyst, and the content of said alkali metal therein is in the range of 1%~30% by weight of the catalyst.

23. A CrN film according to claim 18, wherein said Cr plated layer is purified and activated by heating in an atmosphere comprising a halogen compound or a reactive gas which includes a halogen prior to nitriding.

24. A CrN film according to claim 23, wherein said halogen compound or reactive gas which includes a halogen is a fluorine compound or a gas including fluoride.

25. A CrN film according to claim 24, wherein said reactive gas which includes a halogen is a reactive gas which includes $ClF_3$.

* * * * *